US006840321B2

(12) United States Patent
Restarick et al.

(10) Patent No.: US 6,840,321 B2
(45) Date of Patent: Jan. 11, 2005

(54) MULTILATERAL INJECTION/PRODUCTION/ STORAGE COMPLETION SYSTEM

(75) Inventors: Henry L. Restarick, Carrollton, TX (US); Jody R. McGlothen, Waxahachie, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 38 days.

(21) Appl. No.: 10/253,136

(22) Filed: Sep. 24, 2002

(65) Prior Publication Data

US 2004/0055750 A1 Mar. 25, 2004

(51) Int. Cl.[7] ..... E21B 43/38

(52) U.S. Cl. ..... 166/313; 166/169; 166/268

(58) Field of Search ..... 166/313, 369, 166/52, 50, 306, 373, 169, 242.3, 242.5, 269, 265, 279, 266

(56) References Cited

U.S. PATENT DOCUMENTS

| | | | | |
|---|---|---|---|---|
| 4,646,836 A | * | 3/1987 | Goodhart | 166/303 |
| 5,123,488 A | * | 6/1992 | Jennings, Jr. | 166/306 |
| 5,127,457 A | * | 7/1992 | Stewart et al. | 166/306 |
| 5,311,936 A | | 5/1994 | McNair et al. | |
| 5,318,122 A | | 6/1994 | Murray et al. | |
| 5,330,007 A | | 7/1994 | Collins et al. | |
| 5,339,904 A | | 8/1994 | Jennings, Jr. et al. | |
| 5,462,120 A | | 10/1995 | Gondouin | |
| 5,484,383 A | | 1/1996 | Fitch, Jr. et al. | |
| 5,680,901 A | * | 10/1997 | Gardes | 166/313 |
| 5,839,508 A | | 11/1998 | Tubel et al. | |
| 5,868,210 A | * | 2/1999 | Johnson et al. | 175/40 |
| 5,875,847 A | | 3/1999 | Forsyth | |
| 5,879,108 A | * | 3/1999 | Haddad | 405/128.45 |
| 5,941,308 A | * | 8/1999 | Malone et al. | 166/313 |
| 6,082,455 A | | 7/2000 | Pringle et al. | |
| 6,089,320 A | | 7/2000 | LaGrange | |
| 6,119,771 A | | 9/2000 | Gano et al. | |
| 6,247,532 B1 | * | 6/2001 | Ohmer | 166/50 |
| 6,253,846 B1 | | 7/2001 | Nazzal et al. | |
| 6,279,651 B1 | * | 8/2001 | Schwendemann et al. | 166/54.1 |
| 6,279,658 B1 | * | 8/2001 | Donovan et al. | 166/313 |
| 6,354,375 B1 | | 3/2002 | Dewey | |
| 6,422,312 B1 | * | 7/2002 | Delatorre et al. | 166/250.15 |
| 6,431,283 B1 | | 8/2002 | Dale | |

(List continued on next page.)

FOREIGN PATENT DOCUMENTS

| | | |
|---|---|---|
| CA | 2301966 A1 | 9/2001 |
| GB | 2 345 933 A | 7/2000 |
| WO | WO 01/11185 A1 | 2/2001 |
| WO | WO 01/71151 A1 | 9/2001 |

OTHER PUBLICATIONS

Office Action for Ser. No. 10/253,324 dated Mar. 30, 2004.

International Search Report for application No. PCT/US03/26791.

International Search Report for application No. PCT/US03/26360.

Office Action for Ser. No. 10/253,671 dated May 19, 2004.

*Primary Examiner*—David Bagnell
*Assistant Examiner*—Daniel Stephenson
(74) *Attorney, Agent, or Firm*—Marlin R. Smith

(57) ABSTRACT

A multilateral injection/production/storage completion system. In a described embodiment, a method of completing a well having a first wellbore intersecting each of second, third and fourth wellbores includes the steps of: injecting a first fluid into a first zone intersected by the second wellbore; receiving a second fluid into the third wellbore in response to the first fluid injecting step; flowing the second fluid from the third wellbore to the fourth wellbore; storing the second fluid in a second zone intersected by the fourth wellbore; and then producing the second fluid from the second zone to a remote location.

51 Claims, 6 Drawing Sheets

U.S. PATENT DOCUMENTS 6,615,920 B1 * 9/2003 Collins et al. ..... 166/313
2002/0053437 A1 * 5/2002 Ohmer ..... 166/313
2002/0088621 A1 7/2002 Hamilton
2002/0112857 A1 * 8/2002 Ohmer et al. ..... 166/313
2003/0024700 A1 * 2/2003 Cavender ..... 166/278

* cited by examiner

MULTILATERAL INJECTION/PRODUCTION/ STORAGE COMPLETION SYSTEM

BACKGROUND

The present invention relates generally to operations performed and equipment utilized in conjunction with subterranean wells and, in an embodiment described herein, more particularly provides multilateral well completion systems and methods.

A typical multilateral well includes multiple lateral or branch wellbores. The multiple branch wellbores could be used for variously injecting, transferring, storing and producing fluids in these wells. However, at present no satisfactory systems and methods are commercially available for accomplishing these functions conveniently, cost effectively and reliably in multilateral wells.

Furthermore, it is difficult if not impossible to change a typical multilateral completion system without pulling the system from the well. Thus, if well conditions change, for example, if it is desired to inject or store fluids in a zone which was formerly produced, typical multilateral completion systems must be pulled from the well and be reconfigured or replaced to conform to the new well conditions.

Therefore, it is well known by those skilled in the art that improved systems and methods are needed for multilateral well completions. Preferably, such improved multilateral well completion systems and methods should be adaptable to changing well conditions and configurable to suit a variety of situations.

SUMMARY

In carrying out the principles of the present invention, in accordance with an embodiment thereof, a well completion system is provided which includes the capability of performing a variety of functions with convenience and economy. Associated methods are also provided.

In one aspect of the invention, a system for completing a well having a first wellbore intersecting each of second, third and fourth wellbores is provided. The system includes a casing string positioned in the first wellbore. A first fluid is injected into the second wellbore. A second fluid is received into the third wellbore. The second fluid may be flowed into the third wellbore in response to the first fluid flowing into the second wellbore.

The second fluid is transferred from the third wellbore to the fourth wellbore for storage therein and later production. The transfer of the second fluid is accomplished by way of a passage in the first wellbore isolated from the casing string.

In another aspect of the invention, a method of completing a well having a first wellbore intersecting each of second, third and fourth wellbores is provided. The method includes the steps of: injecting a first fluid into a first zone intersected by the second wellbore; receiving a second fluid into the third wellbore in response to the first fluid injecting step; flowing the second fluid from the third wellbore to the fourth wellbore; storing the second fluid in a second zone intersected by the fourth wellbore; and then producing the second fluid from the second zone to a remote location.

In yet another aspect of the invention, another method of completing a well having a first wellbore intersecting each of second, third and fourth wellbores is provided. The method includes the steps of: interconnecting first, second and third apparatuses in a casing string, each of the apparatuses having a first passage forming a part of a longitudinal flow passage of the casing string, and a second passage intersecting the first passage; positioning the casing string in the first wellbore; injecting a first fluid through the first apparatus second passage into the second wellbore; receiving a second fluid from the third wellbore into the second apparatus second passage; flowing the second fluid from the second apparatus to the third apparatus; and storing the second fluid in a zone intersected by the fourth wellbore.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
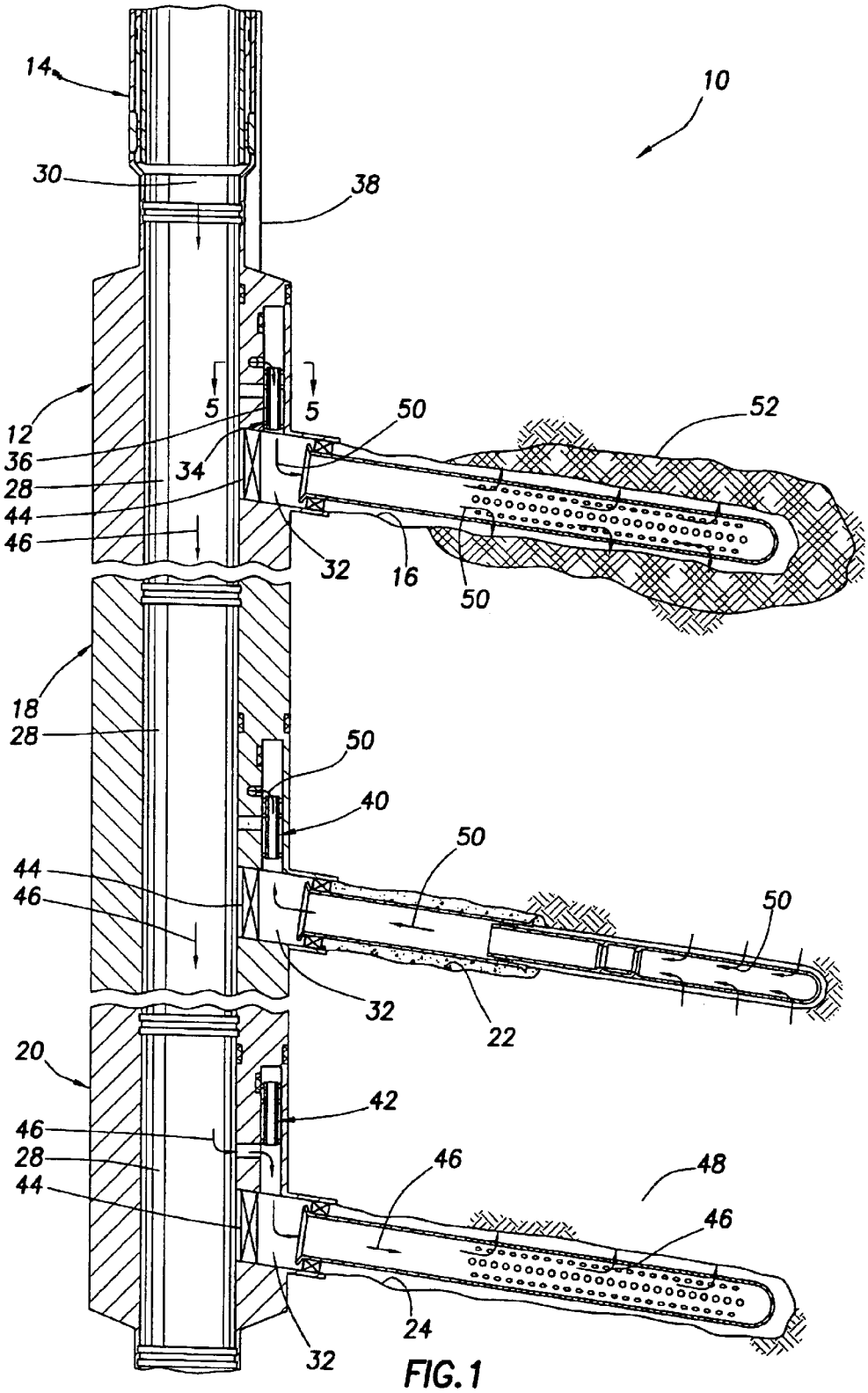
FIG. 1 is a schematic cross-sectional view of a first system and method embodying principles of the present invention, shown in an injection/storage configuration.

Representatively illustrated in FIG. 1 is a system 10 which embodies principles of the present invention. In the following description of the system 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

The incorporated copending applications describe how an apparatus, such as the apparatus 12 depicted in FIG. 1, is interconnected in a casing string 14, positioned in a parent or main wellbore, cemented in the parent wellbore, and is used to drill a branch wellbore 16. In FIG. 1, three of the apparatuses 12, 18, 20 are used to drill three corresponding branch wellbores 16, 22, 24. The parent wellbore is not shown in FIG. 1 for illustrative clarity.

Figure 5:
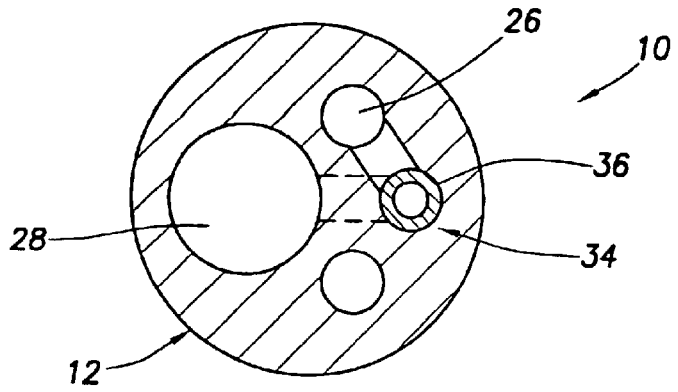
FIG. 5 is an enlarged scale cross-sectional view of the first system and method, taken along line 5—5 of FIG. 1.

The incorporated copending applications also describe how fluid communication may be provided between apparatuses interconnected in a casing string using passages formed in the apparatuses and selectively isolated from an internal flow passage of the casing string. In the system 10, the upper two apparatuses 12, 18 are in fluid communication via a passage 26 formed in each of the apparatuses. The passage 26 is visible in FIG. 5, which is a cross-sectional view of the upper apparatus 12, taken along line 5—5 of FIG. 1. The middle apparatus 18 has a similar cross-section in the system 10 as depicted in FIG. 1.

Each of the apparatuses 12, 18, 20 has a passage 28 formed longitudinally therethrough which is a part of an internal longitudinal flow passage 30 of the casing string 14. Each of the apparatuses 12, 18, 20 also has a passage 32 which intersects and extends laterally relative to the passage 28. The branch wellbores 16, 22, 24 are drilled by deflecting cutting tools from the passage 28 through the passage 32 of the corresponding one of the apparatuses 12, 18, 20.

The upper apparatus 12 includes a flow control device 34 which controls flow between the passage 32 and the passage 26, and which also controls flow between the passages 32, 28 of the apparatus 12. The flow control device 34 is depicted in FIG. 1 as including a sliding sleeve 36, however, any type of flow control device, such as a ball valve, a flapper-type valve, a choke, etc., may be used for the flow control device 34. Although not illustrated in FIG. 1, the flow control device 34 preferably also includes an actuator remotely controllable via lines 38 (such as hydraulic, electric or fiber optic lines) extending to a remote location (such as the earth's surface or another location in the well). The flow control device 34 may also, or alternatively, be controlled by telemetry (such as electromagnetic, pressure pulse or acoustic telemetry). The flow control device 34 may include a control module to permit communication with the remote location, decode telemetry signals, etc.

The middle apparatus 18 also includes a flow control device 40 which is similar to the flow control device 34 described above. The flow control device 40 also controls flow between the passages 26, 32 and between the passages 28, 32 in the apparatus 18.

The lower apparatus 20 also includes a flow control device 42 which is similar in many respects to the flow control devices 34, 40. However, the lower apparatus 20 does not have the passage 26 formed therein, so the flow control device 42 only controls flow between the passages 28, 32 in the lower apparatus.

In each of the apparatuses 12, 18, 20, a plug 44 is installed after the corresponding one of the branch wellbores 16, 22, 24 is drilled. The plug 44 prevents direct flow between the passages 28, 32 in each of the apparatuses 12, 18, 20.

As depicted in FIG. 1, the system 10 is configured for an injection/storage operation in the well. The flow control device 34 is configured to permit flow between the passages 26, 32 and prevent flow between the passages 28, 32. The flow control device 40 is configured to permit flow between the passages 26, 32 and prevent flow between the passages 28, 32. The flow control device 42 is configured to permit flow between the passages 28, 32.

Fluid (indicated by arrows 46), such as water or steam, is flowed down through the casing string 14 into the passage 28 of the lower apparatus 20. The fluid 46 flows through the flow control device 42 and through the passage 32 into the branch wellbore 24. The fluid 46 then flows outward into a formation or zone 48 intersected by the branch wellbore 24.

This flow of the fluid 46 into the zone 48 causes or at least enhances the flow of another fluid (indicated by arrows 50), such as oil or gas, into the branch wellbore 22. Preferably, the branch wellbore 22 intersects the same zone 48 as intersected by the branch wellbore 24. It will be readily appreciated by one skilled in the art how flowing a relatively dense fluid, such as water, into a zone will force a relatively less dense fluid, such as oil or gas to rise in a zone. In this situation, the fluid 46 is injected into a lower portion of the zone 48, and the hydrocarbon bearing fluid 50 is flowed out of an upper portion of the zone 48.

However, it should be understood that these fluids and relative positions are not necessary in keeping with the principles of the invention. For example, a relatively less dense fluid, such as gas, could be injected into an upper portion of a zone, while a relatively more dense fluid, such as oil is flowed from a lower portion of a zone.

Figure 6:
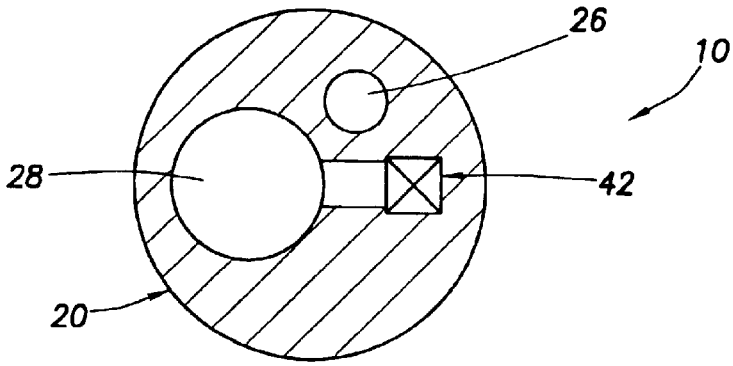
FIG. 6 is a cross-sectional view of a first alternate mandrel and passage configuration.

In this situation, the apparatuses 18, 20 could be in reversed positions as compared to the configuration shown in FIG. 1. If the apparatus 20 is interconnected in the casing string 14 between the apparatuses 12, 18, then the apparatus 20 could have a cross-section as depicted in FIG. 6. This alternative cross-section provides the passage 26 through the apparatus 20 for fluid communication between the flow control devices 34, 40 of the apparatuses 12, 18.

As another alternative, the apparatus 20 could be configured similar to the other apparatuses 12, 18, wherein the flow control device 42 is also capable of controlling flow between the passages 26, 32. Thus, it will be appreciated that many different configurations are possible, and the apparatuses 12, 18, 20 may have different relative positions, without departing from the principles of the invention.

The fluid 50 received into the branch wellbore 22 is flowed through the flow control device 40 and into the passage 26 in the middle apparatus 18. The fluid 50 then flows from the passage 26, through the flow control device 34 and into the passage 32 in the upper apparatus 12. The fluid 50 then flows into the branch wellbore 16 and outward into a formation or zone 52 intersected by the branch wellbore 16. The zone 52 may or may not be the same as the zone 48 into which the fluid 46 is injected.

If the fluid 50 is gas, or at least less dense than the fluid 46, then the zone 52 could be an upper portion of the zone 48. For gas or oil storage, the zone 52 could also be completely isolated from the zone 48. Note that the injected fluid 46 could be gas, in which case the fluid 50 could be stored in the zone 52 which could be a lower portion of the zone 48, in which case the apparatus 12 would be switched with the apparatus 20 in the casing string 14.

Thus, as depicted in FIG. 1, the fluid 46 is injected into the zone 48 through the apparatus 20, and in response the fluid 50 is received into the branch wellbore 22. The fluid 50 flows through the passage 26 between the apparatuses 12, 18. The fluid 50 then flows through the apparatus 12 and into the zone 52 for storage therein.

Figure 2:
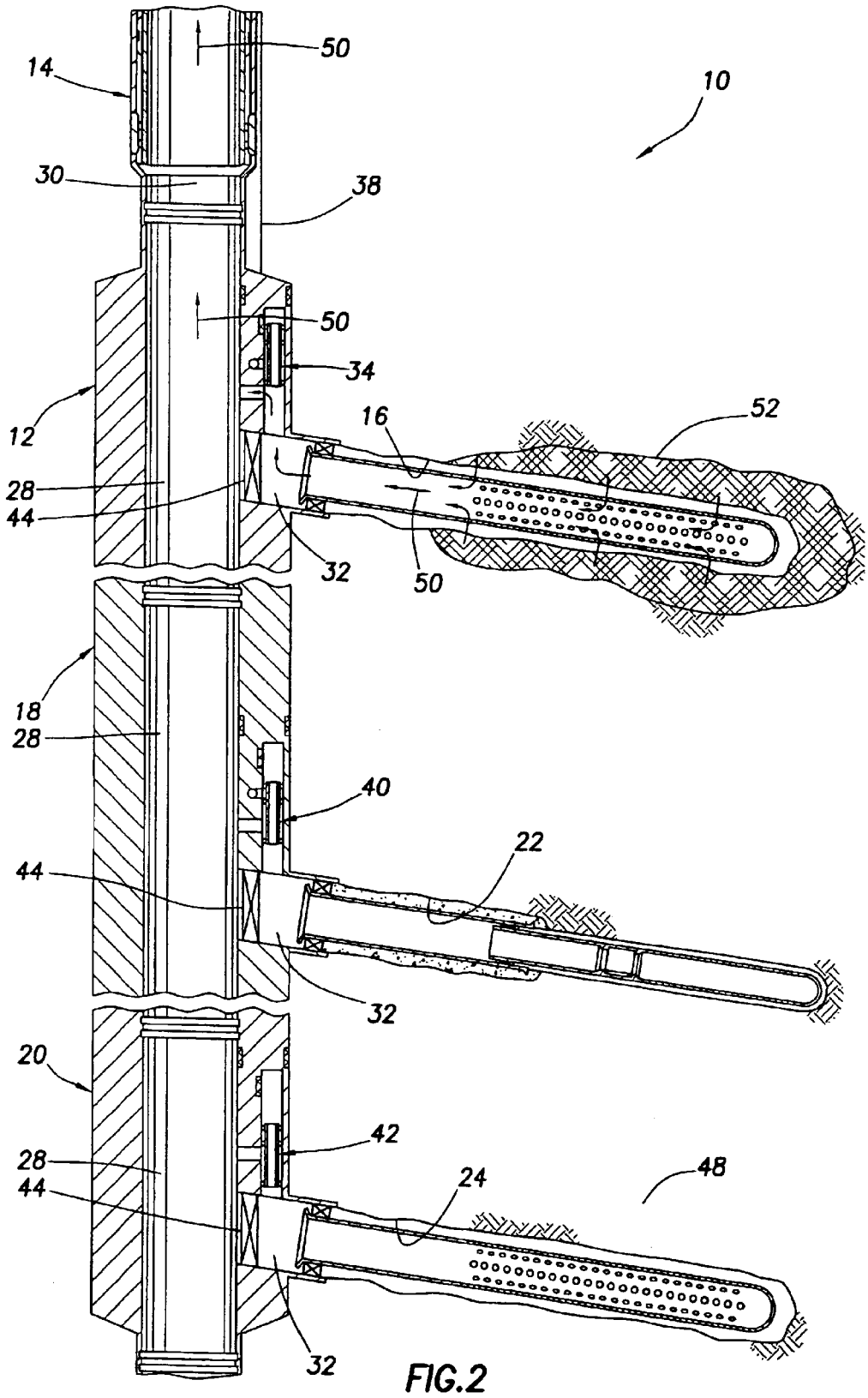
FIG. 2 is a schematic cross-sectional view of the first system and method, shown in a production configuration.

Referring additionally now to FIG. 2, the system 10 is depicted in a configuration in which the previously stored fluid 50 is produced from the zone 52 in which it was stored. In this configuration, the flow control device 34 in the upper apparatus 12 permits flow between the passages 28, 32 in the apparatus. The flow control device 40 in the middle apparatus 18 prevents flow between the passages 28, 32, and prevents flow between the passages 26, 32. The flow control device 42 in the lower apparatus 20 prevents flow between the passages 28, 32.

The fluid 50 flows out of the zone 52 and into the branch wellbore 16. The fluid 50 then flows into the passage 32, through the flow control device 34 and into the passage 28. The fluid 50 may then flow through the casing string passage 30 to a remote location, such as the earth's surface.

Figure 3:
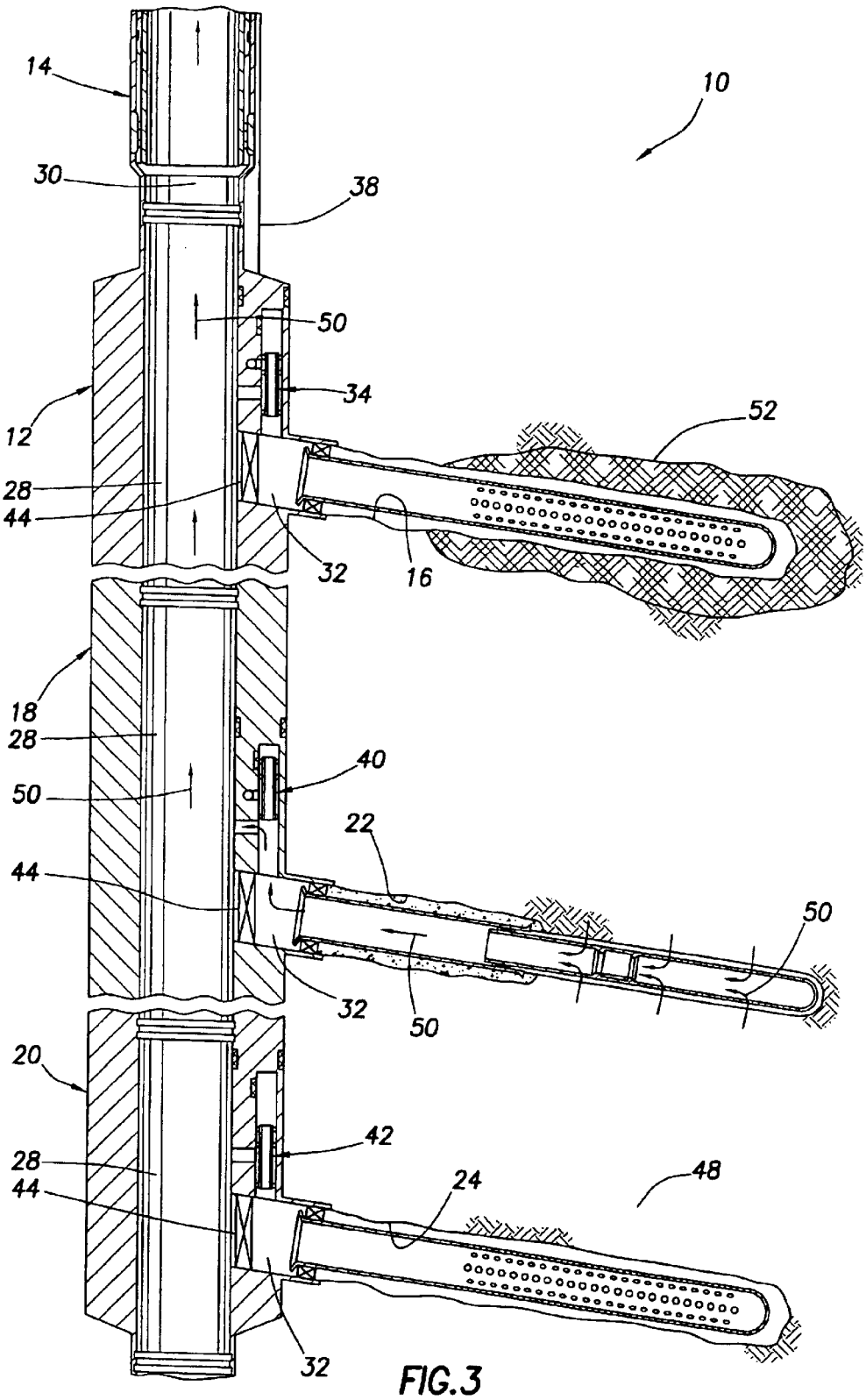
FIG. 3 is a schematic cross-sectional view of the first system and method, shown in an alternate production configuration.

Referring additionally now to FIG. 3, the system 10 is depicted in a configuration in which the fluid 50 is produced from the branch wellbore 22 without being stored in the zone 52. Instead, the fluid 50 flows into the passage 32, through the flow control device 40 and into the passage 28 in the middle apparatus 18. The fluid 50 may then be produced through the casing string passage 30 to the remote location.

In this configuration, the flow control device 40 permits flow between the passages 28, 32, but prevents flow between the passages 26, 32, in the middle apparatus 18. The flow control device 34 prevents flow between the passages 26, 32 and between the passages 28, 32 in the upper apparatus 12. The flow control device 42 prevents flow between the passages 28, 32 in the lower apparatus 20.

Figure 4:
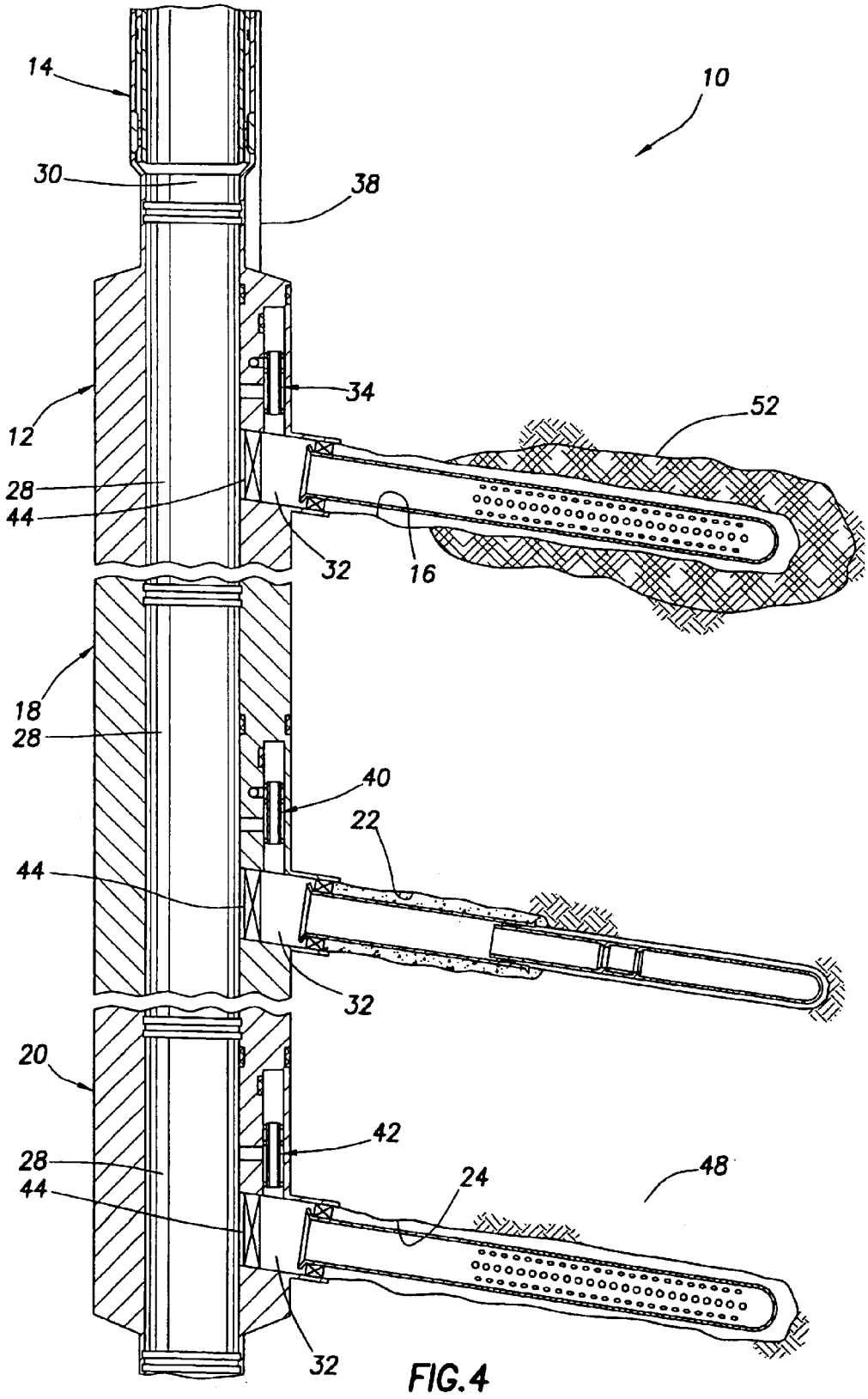
FIG. 4 is a schematic cross-sectional view of the first system and method, shown in a shut-in configuration.

Referring additionally now to FIG. 4, the system 10 is depicted in a configuration in which each of the three branch wellbores 16, 22, 24 is shut-in. The flow control device 34 prevents flow between the passages 26, 32 and between the passages 28, 32 in the upper apparatus 12. The flow control device 40 prevents flow between the passages 28, 32 and between the passages 26, 32, in the middle apparatus 18. The flow control device 42 prevents flow between the passages 28, 32 in the lower apparatus 20.

This configuration may be used, for example, when an emergency situation occurs. Each of the flow control devices 34, 40, 42 may perform the function of a safety valve to shut in the corresponding one of the branch wellbores 16, 22, 24. The flow control devices 34, 40, 42 may respond to a signal transmitted from a remote location (e.g., via telemetry or via the lines 38), or they may respond to conditions sensed downhole, to close off flow therethrough.

It may now be fully appreciated how the system 10 provides enhanced functionality, convenience and versatility in multilateral completions. Although only three apparatuses 12, 18, 20 are illustrated in FIGS. 1-4, any number of apparatuses may be used in the system 10, for example, another apparatus may be included in the casing string 14 for producing fluid from another zone intersected by the well, for injecting fluid into another zone, or for storing fluid in another zone. Additional apparatuses may be interconnected at virtually any desired position in the casing string 14.

Note that it is not necessary for the system 10 to be configured as depicted in FIGS. 1-4. Any of the zones 48, 52 could be otherwise positioned, and otherwise positioned relative to the other zone(s). The apparatuses 12, 18, 20 could be otherwise positioned, and otherwise positioned relative to the other apparatuses. Any of the branch wellbores 16, 22, 24 could be an extension of the parent wellbore, and the branch wellbores are not necessarily drilled through the apparatuses 12, 18, 20.

Figure 8:
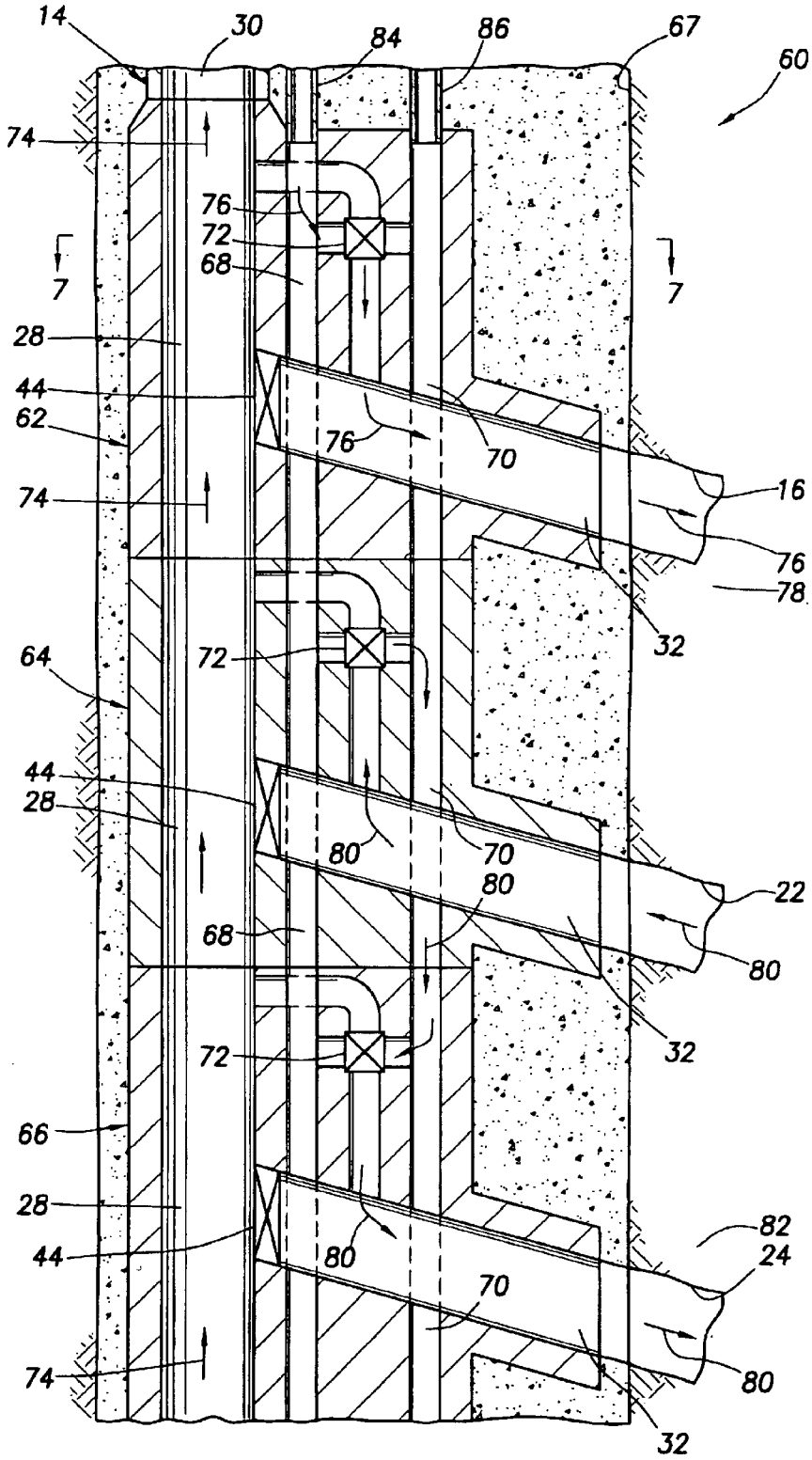
FIG. 8 is a schematic cross-sectional view of a second system and method embodying principles of the present invention.

Referring additionally now to FIG. 8, another system 60 embodying principles of the invention is schematically and representatively illustrated. The system 6o is similar in many respects to the system 10 described above. Elements which are similar to those previously described are indicated in FIG. 8 using the same reference numbers.

The system 60 uses three apparatuses 62, 64, 66 interconnected in a casing string 14 and cemented within a parent wellbore 67, as in the system 10. The branch wellbores 16, 22, 24 are drilled through the passages 32 of the corresponding one of the apparatuses 62, 64, 66. A plug 44 is installed after drilling to prevent direct flow between the passages 28, 32 in each of the apparatuses 62, 64, 66.

However, in the system 60 the apparatuses 62, 64, 66 are identical to each other. Each of the apparatuses 62, 64, 66 has two passages 68, 70 formed therethrough and a flow control device 72 for controlling flow between the passage 32 and each of the passages 28, 68, 70. That is, the flow control device 72 selectively permits and prevents flow between the passage 32 and each of the passages 28, 68, 70 in each of the apparatuses 62, 64, 66.

Figure 7:
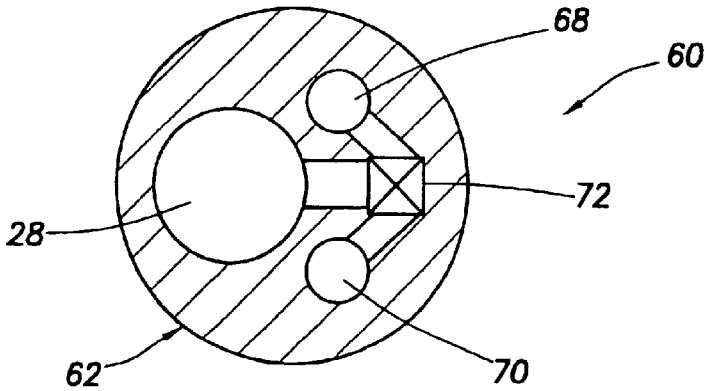
FIG. 7 is a cross-sectional view of a second alternate mandrel and passage configuration.

A cross-sectional view of the apparatus 62 is depicted in FIG. 7, taken along line 7—7 of FIG. 8. In this view the arrangement of the passages 28, 68, 70 may be clearly seen. The passages 68, 70 are depicted side-by-side in FIG. 8 for clarity of illustration and description.

To control flow between the passages 28, 32, 68, 70, the flow control device 72 is preferably of the type known to those skilled in the art as a "four way" valve. However, it should be understood that other numbers of flow control devices and other types of flow control devices could be used in keeping with the principles of the invention. For example, a separate valve could be used for controlling flow between the passage 32 and each one of the other passages 28, 68,70.

The passages 68, 70 are provided in the apparatuses 62, 64, 66 in order to isolate injection and transfer flows from the casing string flow passage 30. This configuration may be desired in situations in which fluid (indicated by arrows 74) is to be produced through the casing string flow passage 30 while fluid is being injected into one branch wellbore and fluid is being transferred between branch wellbores through the other passages 68, 70.

A fluid (indicated by arrows 76), such as gas, may be injected from the passage 68, through the flow control device 72 and into the passage 32 in the upper apparatus 62. The fluid 76 would then flow into the branch wellbore 16 and outward into a formation or zone 78 intersected by the branch wellbore. The flow control device 72 in the upper apparatus 62 would permit flow between the passages 32, 68, but prevent flow between the passages 32, 70 and between the passages 28, 32.

Flow of the fluid 76 into the zone 78 would cause, or at least enhance, flow of another fluid (indicated by arrows 80), such as oil, into the branch wellbore 22. The fluid 80 would then flow into the passage 32, through the flow control device 72 and into the passage 70 in the middle apparatus 64. The flow control device 72 would permit flow between the passages 32, 70, but would prevent flow between the passages 28, 32 and between the passages 32, 68. The fluid 80 would flow from the middle apparatus 64 to the lower apparatus 66 through the passage 70.

In the lower apparatus 66, the fluid 80 would flow from the passage 70, through the flow control device 72 and into the passage 32. The fluid 80 would then flow into the branch wellbore 24 and outward into a formation or zone 82 intersected by the branch wellbore. The flow control device 72 in the lower apparatus 66 could permit flow between the passages 32, 70, but would prevent flow between the passages 28, 32 and between the passages 32, 68.

The fluid 80 would be stored in the zone 82. The zone 82 could be a lower portion of the zone 78, or it could be completely isolated from the zone 78. The fluid 80 could be produced from the zone 82 by actuating the flow control device 72 in the lower apparatus 66 to permit flow between the passages 28, 32, but prevent flow between the passages 32, 68 and between the passages 32, 70.

It will be readily appreciated that any number of the apparatuses 62, 64, 66 could be interconnected in the casing string 14 to inject fluid into, transfer fluid between, or produce fluid from any number of branch wellbores. For example, the fluid 74 could be produced through another apparatus interconnected below the lower apparatus 66. Furthermore, the apparatuses 62, 64, 66 may have any relative position with respect to the other apparatuses, and the apparatuses may be similarly or differently configured.

Instead of injecting the fluid 76 through the casing string flow passage 30, in the system 60 the fluid is received into the upper apparatus 62 from a tubular string 84 extending to a remote location. The passage 68 extends through the tubular string 84.

The tubular string 84 is external to the casing string 14 in the parent wellbore 67 and is isolated from the casing string flow passage 30. This permits injection of the fluid 76 while the fluid 74 is produced through the casing string flow passage 30.

Another tubular string 86 could be connected to the upper apparatus 62, if desired, to convey the fluid 80 to a remote location. In that case, the passage 70 would extend through the tubular string 86, permitting the fluid 80 to flow through the tubular string 86 to the remote location, for example, for testing or for production separate from the fluid 74 produced through the casing string 14 in situations where commingling of the fluids 74, 80 is not desired, or is not permitted.

The system 60 demonstrates the wide range of multilateral well completions which may be accomplished using the principles of the invention. Fluid may be injected into any branch wellbore 16, 22, 24 by merely permitting flow between the passages 32, 68 in the associated one of the apparatuses 62, 64, 66. Fluid may be transferred between any of the apparatuses 62, 64, 66 by merely permitting flow between the passages 32, 70 in each of the apparatuses. Fluid may be produced from any of the branch wellbores 16, 22, 24 by merely permitting flow between the passages 28, 32 in the associated one of the apparatuses 62, 64, 66.

Fluid may be injected into multiple branch wellbores, transferred between more than two branch wellbores, stored in multiple branch wellbores, and produced from multiple branch wellbores simultaneously. Additional apparatuses may be interconnected in the casing string 14 to permit these operations to be performed in additional branch wellbores.

Since each apparatus has injection, fluid transfer and production capabilities (due to the passages 28, 68, 70 being formed in each apparatus), any of these operations may be performed in any of the apparatuses at any time. For example, the upper branch wellbore 16 could have produced oil when the well was initially completed. Later, after much of the oil is depleted from the upper portion of the zone 78, the branch wellbore 16 may be used to inject gas into the zone to enhance oil recovery from the lower portion of the zone via the branch wellbore 22. The gas injected into the zone 78 could be separated from the fluid 80 produced from the zone 78, or from another zone.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. For example, in either of the systems 10, 60, any of the branch wellbores 16, 22, 24 could be an extension or another portion of the parent wellbore 67, the plug 44 could be replaced by packers straddling the passage 32 in the passage 28, it is not necessary for the branch wellbores 16, 22, 24 to be drilled through the apparatuses, etc. Accordingly, the foregoing detailed description is to be clearly understood as being given by way of illustration and example only, the spirit and scope of the present invention being limited solely by the appended claims and their equivalents.

What is claimed is:

1. A system for completing a well having a first wellbore intersecting each of second, third and fourth wellbores, the system comprising:

a casing string positioned in the first wellbore;

a first fluid being injected into the second wellbore;

a second fluid being received into the third wellbore; and the second fluid being flowed from the third wellbore to the fourth wellbore.

2. The system according to claim 1, wherein the second fluid is stored in a zone intersected by the fourth wellbore.

3. The system according to claim 2, wherein the second fluid is produced to a remote location from the fourth wellbore after being stored in the zone.

4. The system according to claim 1, wherein the second fluid is flowed between the third and fourth wellbores through a passage isolated from a longitudinal flow passage of the casing string.

5. The system according to claim 1, wherein the first fluid is injected into a zone intersected by the first and second wellbores.

6. The system according to claim 1, wherein the second fluid is received into the third wellbore in response to the first fluid being injected into the second wellbore.

7. The system according to claim 1, wherein the first fluid is injected into the second wellbore by flowing the first fluid through a longitudinal flow passage of the casing string and then outward into the second wellbore, and wherein the second fluid is flowed through another passage in the first wellbore isolated from the casing string flow passage.

8. The system according to claim 7, wherein the first fluid is flowed through the casing string flow passage while the second fluid is flowed between the third and fourth wellbores.

9. The system according to claim 1, wherein the casing string includes first, second and third apparatuses, each of the second, third and fourth wellbores being drilled through a corresponding one of the first, second and third apparatuses.

10. The system according to claim 1, wherein the casing string includes first, second and third apparatuses, each of the apparatuses having a first passage forming a part of the casing string flow passage, and a second passage extending laterally relative to the first passage, the first fluid being injected through the first apparatus second passage, the second fluid being received into the second apparatus second passage, the second fluid being flowed through the third apparatus second passage to the fourth wellbore.

11. A method of completing a well having a first wellbore intersecting each of second, third and fourth wellbores, the method comprising the steps of:

injecting a first fluid into a first zone intersected by the second wellbore;

receiving a second fluid into the third wellbore in response to the first fluid injecting step;

flowing the second fluid from the third wellbore to the fourth wellbore;

storing the second fluid in a second zone intersected by the fourth wellbore; and then producing the second fluid from the second zone to a remote location.

12. The method according to claim 11, wherein the receiving step further comprises receiving the second fluid from the first zone intersected by the second wellbore.

13. The method according to claim 11, wherein in the receiving step, the third wellbore intersects the first zone.

14. The method according to claim 11, wherein the injecting step further comprises injecting the first fluid through an apparatus interconnected in a casing string in the first wellbore, the first fluid flowing through a longitudinal flow passage of the casing string.

15. The method according to claim 11, wherein the receiving step further comprises receiving the second fluid from the third wellbore into an apparatus interconnected in a casing string in the first wellbore.

16. The method according to claim 15, wherein the receiving step further comprises receiving the second fluid into a passage of the apparatus isolated from a longitudinal flow passage of the casing string.

17. The method according to claim 11, wherein the flowing step further comprises flowing the second fluid between two apparatuses interconnected in a casing string in the first wellbore.

18. The method according to claim 17, wherein the flowing step further comprises flowing the second fluid through a passage isolated from a longitudinal flow passage of the casing string.

19. The method according to claim 11, wherein in the storing step, the second fluid is flowed through a passage isolated from a longitudinal flow passage of a casing string positioned in the first wellbore.

20. The method according to claim 11, wherein the producing step further comprises producing the second fluid through a longitudinal flow passage of a casing string positioned in the first wellbore, the passage having been used to flow the first fluid through the casing string in the injecting step.

21. The method according to claim 11, wherein the producing step further comprises producing the second fluid through a passage isolated from a longitudinal flow passage of a casing string positioned in the first wellbore.

22. The method according to claim 11, further comprising the step of producing the second fluid from the third wellbore to the remote location.

23. The method according to claim 22, further comprising the step of interconnecting multiple apparatuses in a casing string, each of the apparatuses having intersecting first and second passages, the first passage forming a part of an internal flow passage of the casing string, and the second passage extending laterally relative to the first passage.

24. The method according to claim 23, further comprising the step of positioning the casing string in the first wellbore with the apparatuses positioned opposite desired locations for drilling the second, third and fourth wellbores.

25. The method according to claim 24, further comprising the step of drilling the second, third and fourth wellbores through the second passages of the apparatuses.

26. The method according to claim 25, wherein the injecting step further comprises flowing the first fluid through the casing string flow passage and then through one of the apparatuses into the second wellbore.

27. The method according to claim 25, wherein the injecting step further comprises flowing the first fluid through a third passage formed in one of the apparatuses into the second wellbore, the third passage being isolated from the casing string flow passage.

28. The method according to claim 27, wherein the first fluid flowing step further comprises flowing the first fluid through a tubular string adjacent the casing string in the first wellbore.

29. The method according to claim 25, wherein the second fluid flowing step further comprises flowing the second fluid through a third passage between two of the apparatuses, the third passage being isolated from the casing string flow passage.

30. The method according to claim 25, wherein the producing step further comprises flowing the second fluid through one of the apparatuses between the first and second passages.

31. A method of completing a well having a first wellbore intersecting each of second, third and fourth wellbores, the method comprising the steps of:

interconnecting first, second and third apparatuses in a casing string, each of the apparatuses having a first passage forming a part of a longitudinal flow passage of the casing string, and a second passage intersecting the first passage;

positioning the casing string in the first wellbore;

injecting a first fluid through the first apparatus second passage into the second wellbore;

receiving a second fluid from the third wellbore into the second apparatus second passage;

flowing the second fluid from the second apparatus to the third apparatus; and storing the second fluid in a zone intersected by the fourth wellbore.

32. The method according to claim 31, wherein the injecting step further comprises flowing the first fluid from the first apparatus first passage to the first apparatus second passage.

33. The method according to claim 31, wherein the injecting step further comprises flowing the first fluid through a flow control device interconnected between the first apparatus first passage and the first apparatus second passage.

34. The method according to claim 31, wherein the injecting step further comprises flowing the first fluid between a third passage formed in the first apparatus and the first apparatus second passage, the third passage being isolated from the first apparatus first passage.

35. The method according to claim 31, wherein the injecting step further comprises flowing the first fluid through a flow control device interconnected between the first apparatus second passage and a third passage formed in the first apparatus, the third passage being isolated from the first apparatus first passage.

36. The method according to claim 31, wherein the receiving step further comprises receiving the second fluid into the second apparatus second passage, the second apparatus second passage being isolated from the second apparatus first passage.

37. The method according to claim 31, wherein the flowing step further comprises flowing the second fluid through a third passage between the second and third apparatuses, the third passage being isolated from the casing string flow passage.

38. The method according to claim 37, wherein the flowing step further comprises flowing the second fluid through a flow control device, the flow control device selectively permitting and preventing flow between the third passage and the second apparatus second passage.

39. The method according to claim 38, wherein in the flowing step, the flow control device further selectively permits and prevents flow between the second apparatus first and second passages.

40. The method according to claim 37, wherein the flowing step further comprises flowing the second fluid through a flow control device, the flow control device selectively permitting and preventing flow between the third passage and the third apparatus second passage.

41. The method according to claim 40, wherein in the flowing step, the flow control device further selectively permits and prevents flow between the third apparatus first and second passages.

42. The method according to claim 31, further comprising the step of producing the second fluid from the fourth wellbore after the storing step.

43. The method according to claim 42, wherein the producing step further comprises opening a flow control device interconnected between the third apparatus first and second passages.

44. The method according to claim 42, wherein the producing step further comprises opening a flow control device interconnected between the third apparatus second passage and a third passage isolated from the casing string flow passage.

45. The method according to claim 44, wherein in the producing step, the third passage extends through a tubular string connected to the third apparatus and extending to a remote location.

46. The method according to claim 45, wherein in the producing step, the tubular string is positioned adjacent to the casing string in the first wellbore.

47. The method according to claim 31, further comprising the step of producing the second fluid from the third wellbore through the second apparatus.

48. The method according to claim 47, wherein the producing step further comprises flowing the second fluid through a flow control device interconnected between the second apparatus first and second passages.

49. The method according to claim 47, wherein the producing step further comprises flowing the second fluid through a flow control device interconnected between the second apparatus second passage and a third passage formed in the second apparatus.

50. The method according to claim 49, wherein in the producing step, the third passage is isolated from the second apparatus first passage.

51. The method according to claim 49, wherein in the producing step, the third passage extends through a tubular string adjacent to the casing string in the first wellbore.

* * * * *